US006871983B2

(12) United States Patent
Jacob et al.

(10) Patent No.: US 6,871,983 B2
(45) Date of Patent: Mar. 29, 2005

(54) SOLID STATE CONTINUOUS SEALED CLEAN ROOM LIGHT FIXTURE

(75) Inventors: Stephane Frederick Jacob, Port Moody (CA); Allan Brent York, Langley (CA)

(73) Assignee: TIR Systems Ltd., Vancouver (CA)

( * ) Notice: Subject to any disclaimer, the term of this patent is extended or adjusted under 35 U.S.C. 154(b) by 0 days.

(21) Appl. No.: 10/035,477

(22) Filed: Oct. 25, 2001

(65) Prior Publication Data

US 2003/0081419 A1 May 1, 2003

(51) Int. Cl.[7] ..... F21V 17/00

(52) U.S. Cl. ..... 362/364; 362/574; 362/800; 362/404; 362/545; 362/294; 362/293; 362/33; 362/147; 362/150; 362/245; 362/455; 362/575

(58) Field of Search ..... 362/364, 373, 362/574, 800, 404, 545, 294, 293, 33, 809, 147–148, 150, 241, 245, 247, 455, 459, 575

(56) References Cited

U.S. PATENT DOCUMENTS

| | | | | |
|---|---|---|---|---|
| 4,439,816 A | | 3/1984 | Litchfield | |
| 4,461,205 A | | 7/1984 | Shuler | |
| 4,769,958 A | | 9/1988 | Limp | |
| 4,937,716 A | | 6/1990 | Whitehead | |
| 5,205,632 A | * | 4/1993 | Crinion | 362/33 |
| 5,313,759 A | | 5/1994 | Chase, III | |
| 5,331,785 A | | 7/1994 | Brak | |
| 5,526,236 A | * | 6/1996 | Burnes et al. | 362/20 |
| 5,687,527 A | | 11/1997 | Bikard et al. | |
| 5,794,397 A | | 8/1998 | Ludwig | |
| 5,865,674 A | | 2/1999 | Starr | |
| 5,902,035 A | | 5/1999 | Mui | |
| 5,934,786 A | | 8/1999 | O'Keefe | |
| 6,024,455 A | * | 2/2000 | O'Neill et al. | 359/530 |
| 6,033,085 A | | 3/2000 | Bowker | |
| 6,149,283 A | | 11/2000 | Conway et al. | |
| 6,414,801 B1 | * | 7/2002 | Roller | 359/726 |

FOREIGN PATENT DOCUMENTS

| | | |
|---|---|---|
| EP | 1081771 | 3/2001 |
| FR | 2794927 | 12/2000 |
| JP | 62073026 | 4/1987 |
| WO | 00/57490 | 9/2000 |
| WO | 01/69300 | 9/2001 |

* cited by examiner

*Primary Examiner*—Sandra O'Shea
*Assistant Examiner*—Bertrand Zeade
(74) *Attorney, Agent, or Firm*—Oyen Wiggs Green & Mutala

(57) ABSTRACT

A clean room ceiling light fixture formed as a sealed housing with a downwardly-directed light emitting aperture. A heat sink fixed within and spaced from the housing defines a cable raceway inside the housing. A plurality of LEDs are mounted on the heat sink. A high refractive index (polycarbonate) reflector coupled to each LED efficiently directs the LED's light through the aperture into the clean room. The LEDs and/or reflectors can be anti-reflectively coated to improve light transmission efficiency. A refractive index matching compound applied between each LED-reflector pair further improves light transmission efficiency. A spectrally selective filter material prevents ultraviolet illumination of clean rooms used for lithographic processes which are compromised by ultraviolet rays. A holographic diffusion lens and/or variable transmissivity filter can be provided to uniformly distribute the LEDs' light through the aperture. The fixture can be sized and shaped for snap-fit engagement within the H-Bar type clean room ceiling.

29 Claims, 10 Drawing Sheets

SOLID STATE CONTINUOUS SEALED CLEAN ROOM LIGHT FIXTURE

TECHNICAL FIELD

This invention relates to the illumination of clean rooms utilizing solid state devices such as light emitting diodes (LEDs) provided within a continuous sealed enclosure.

BACKGROUND

A "clean room" is a confined area with a carefully controlled environment and highly restricted access in which the air and all surfaces are kept extremely clean. Clean rooms are used to operate highly sensitive machines, to assemble sensitive equipment such as integrated circuit chips, and to perform other delicate operations which can be compromised by minute quantities of dust, moisture, or other contaminants. Clean rooms are designed to attain differing "classes" of cleanliness, suited to particular applications. The "class" of the clean room defines the maximum number of particles of 0.3 micron size or larger that may exist in one cubic foot of space anywhere in the clean room. For example, a "Class 1" clean room may have only one such particle per cubic foot of space.

Clean room lighting involves a number of challenges. For example, Class 1 clean room lighting fixtures must be recessed within the clean room's ventilated ceiling structure without leaving any particle-entrapping protrusions. Such recessing must not interfere with the ceiling-mounted ventilation equipment which maintains the ceiling-to-floor laminar airflow required to ensure that any particles are carried immediately to the clean room floor vents for removal from the clean room. Due to the presence of the ventilation equipment, there is comparatively little clean room ceiling space within which light fixtures can be recessed without interfering with the ventilation equipment.

Conventionally, clean rooms are illuminated by recessing small diameter fluorescent tubes into whatever space remains within the ceiling after installation of the ventilation equipment. There are several drawbacks to this approach. For example, the fluorescent tubes burn out and must be replaced. Since most clean rooms operate 24 hours per day 7 days per week, and since the fluorescent tube replacement procedure compromises the clean room operational environment, burned out tubes are commonly left in place until the clean room is shut down for annual relamping, at which time all of the fluorescent tubes are replaced whether they are burned out or not. Besides necessitating an expensive shutdown of the clean room, the annual relamping procedure is time-consuming and expensive in its own right.

This invention addresses the foregoing drawbacks with the aid of solid state lighting devices which have significantly longer lifetimes than fluorescent tubes and no breakable glass parts, which can pose a significant clean room contaminant hazard. Solid state lighting devices can also be more than easily configured to produce ultraviolet-free light than fluorescent tubes. Such light is desirable in clean rooms used for lithographic production of integrated circuits.

SUMMARY OF INVENTION

The invention provides a clean room ceiling light fixture formed as a sealed housing with a downwardly-directed light emitting aperture. A heat sink fixed within and spaced from the housing defines a cable raceway inside the housing. A plurality of LEDs are mounted on the heat sink A high refractive index (polycarbonate) reflector coupled to each LED efficiently directs the LED's light through the aperture into the clean room. The LEDs and/or reflectors can be anti-reflectively coated to improve light transmission efficiency. A refractive index matching compound applied between each LED-reflector pair can further improve light transmission efficiency. A spectrally selective filter material can prevent ultraviolet illumination of clean rooms used for lithographic processes which are compromised by ultraviolet rays. A holographic diffusion lens and/or variable transmissivity filter can be provided to uniformly distribute the LEDs' light through the aperture. The fixture can be sized and shaped for snap-fit engagement within the H-Bar type clean room ceiling.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 1:
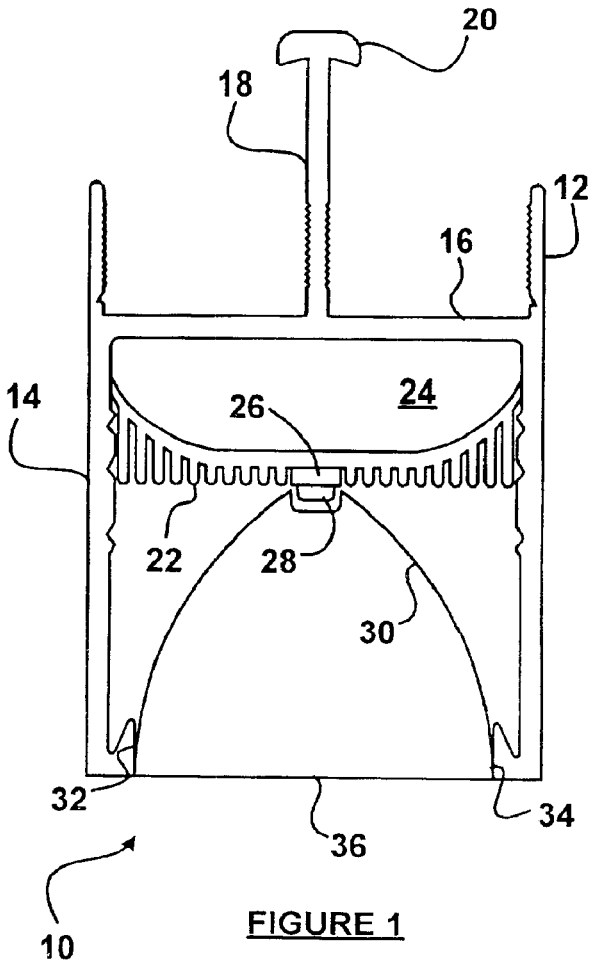
FIG. 1 is a cross-sectional end view of a clean room ceiling lighting fixture incorporating a solid state lighting device in accordance with the invention.

FIG. 1 depicts a clean room ceiling lighting fixture 10 having a unitary "H-Bar" type housing formed of extruded aluminum vertical frame members 12, 14; horizontal frame member 16; hanger 18; and, hanger rail 20. Such H-Bar configurations are commonly found in clean room ceilings, thus simplifying retrofitting of lighting fixture 10 into existing H-Bar type clean room ceilings, and facilitating integration of lighting fixture 10 into new H-Bar type clean room ceilings during initial construction thereof.

Extruded aluminum heat sink 22 is fixed within light fixture 10 to extend the full length of and between vertical frame members 12, 14 and beneath horizontal frame member 16, defining a cable raceway 24 between horizontal frame member 16 and heat sink 22. An important clean room operational requirement is that all air in the clean room must be continually recirculated through filters provided in the clean room ceiling. More particularly, a typical Class 1 clean room has three floors: (1) an upper "semi-clean" walkable plenum space having a floor containing high efficiency particulate air (HEPA) filters; (2) a middle floor comprising the Class 1 clean room space; and, (3) a lower floor air circulation room from which air is recirculated back to the upper plenum space. The H-Bar structure is located between the plenum and clean room spaces and between the HEPA filters. The H-Bar structure must be continuously sealed to provide an air-tight seal between the plenum and clean room spaces. To facilitate this, fixture 10 must itself be a "continuous sealed enclosure". No special sealing is required between heat sink 22 and the housing portion of fixture 10, although it may be useful to apply a temperature-transfer type adhesive sealant between heat sink 22 and the housing.

Figure 11:
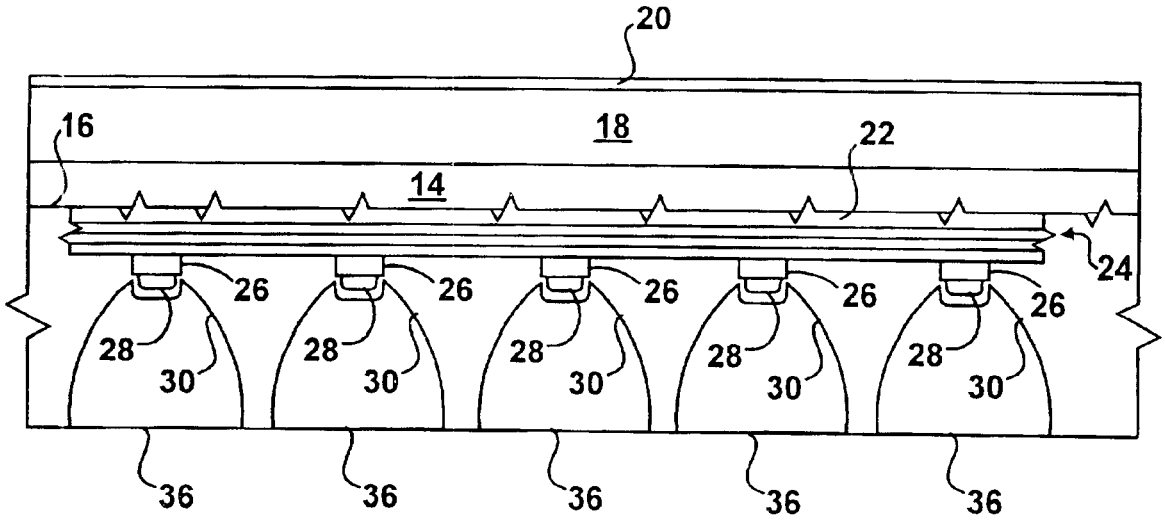
FIG. 11 is a fragmented, schematic side elevation view of a clean room ceiling lighting fixture incorporating a plurality of solid state lighting devices in accordance with the invention.

A plurality of solid state lighting devices 26 (only one of which appears in FIG. 1, but a plurality of which are shown in FIG. 11) are fixed by means of a temperature-transfer type adhesive compound and/or mechanically fixed to the underside of heat sink 22, with the light output lens 28 of each device 26 oriented downwardly. A downwardly projecting, typically parabolic, light reflector 30 is fixed over each lens 28 and mechanically held in place by and between support flanges 32, 34 which are formed on the lower ends of frame members 12, 14 respectively. Each reflector 30 has a flat lower face 36 which extends and is sealed by a silicone or other rubber gasket seal (not shown) between the lowermost edges of flanges 32, 34 giving fixture 10 a gapless lower surface which is flush with the clean room ceiling when fixture 10 is mounted via hanger 18 and rail 20. Lower faces 36 together constitute a downwardly-directed light emitting aperture of light fixture 10, as indicated in FIG. 11.

Power supply and/or control wires (described below with reference to FIG. 10) extend through raceway 24 and through heat sink 22 between a direct current (DC) power supply (described below) and each of devices 26. For example, apertures can be drilled through heat sink 22 at spaced intervals corresponding to the spacing of each of devices 26 along the underside of heat sink 22. After the wires are extended through the apertures, the apertures are silicone-sealed. Devices 26 can be LUXEON™ high intensity light emitting diode (LED) type high flux output devices available from Lumileds Lighting B.V., Eindhoven, Netherlands.

Lenses 28 and reflectors 30 provide more efficient coupling of the light output by LEDs 26 through lower face 36 and into the clean room than prior art fluorescent tube type clean room illumination systems, due to the LEDs' inherently small size and light directing characteristics. By contrast, it is difficult to efficiently couple light output by comparatively large, diffuse light sources such as fluorescent tubes. The difficulty is compounded by the higher "coefficient of utilization" (CU) characteristic of directional light sources for lighting within a room. Directional light is better suited to lighting of task areas, without "wasting" light through unwanted wall or ceiling reflections. Lenses 28 and reflectors 30 improve the directionality of the light output by light fixture 10.

Heat sink 22 must be capable of effectively dissipating the heat produced by LEDs 26, each of which has a very compact light source (~1 square millimeter) and an even smaller heat-producing electrical junction. Preferably, heat sink 22 incorporates the minimum mass of thermally conductive material required to dissipate heat produced by LEDs 26 as quickly as possible. There is comparatively little space within fixture 10 to accommodate heat sink 22, but it is preferable to avoid any protrusion of heat sink 22 outside fixture 10 to minimize potential interference with the ceiling-mounted ventilation equipment. Mounting of heat sink 22 as aforesaid to provide raceway 24 achieves effective heat dissipation and avoids protrusion of the necessary wiring outside fixture 10, again minimizing potential interference with the ventilation equipment and achieving the objective of configuring fixture 10 as a continuously sealed enclosure.

Figure 2:
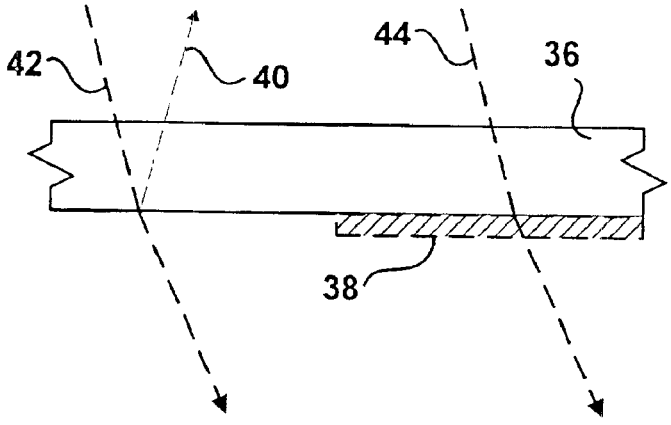
FIG. 2 is an enlarged, fragmented cross-sectional end view of a portion of the FIG. 1 lighting fixture, schematically depicting the effect of applying an anti-reflective coating to the light output reflector.

The light transmitting efficiency of fixture 10 can be improved by chemical or physical vapour deposition of a thin film anti-reflective coating 38 (FIG. 2) to the outward (i.e. lower, as viewed in FIG. 2) surface of reflector 30's lower face 36 and/or between LED 26 and the immediately adjacent portion of reflector 30. As is well known, such coatings optically interfere with light rays incident upon the coated surface, minimizing the amount of light reflected at Fresnel interfaces. This is schematically shown in FIG. 2, the left side of which depicts undesirable reflection 40 of incident ray 42 in the absence of anti-reflective coating 38; and, the right side of which shows how application of anti-reflective coating 38 allows incident ray 44 to pass through reflector 30's lower face 36 without substantial reflection at that interface.

Reflector 30 is preferably formed of a high refractive index material such as polycarbonate having a refractive index n of about 1.6. In accordance with Snell's Law, this makes it possible to decrease the thickness of reflector 30 without reducing the reflector's light reflecting capability, thus conserving the limited space available within fixture 10 and making it possible to increase the size of heat sink 22 which can be accommodated within fixture 10.

Figure 3:
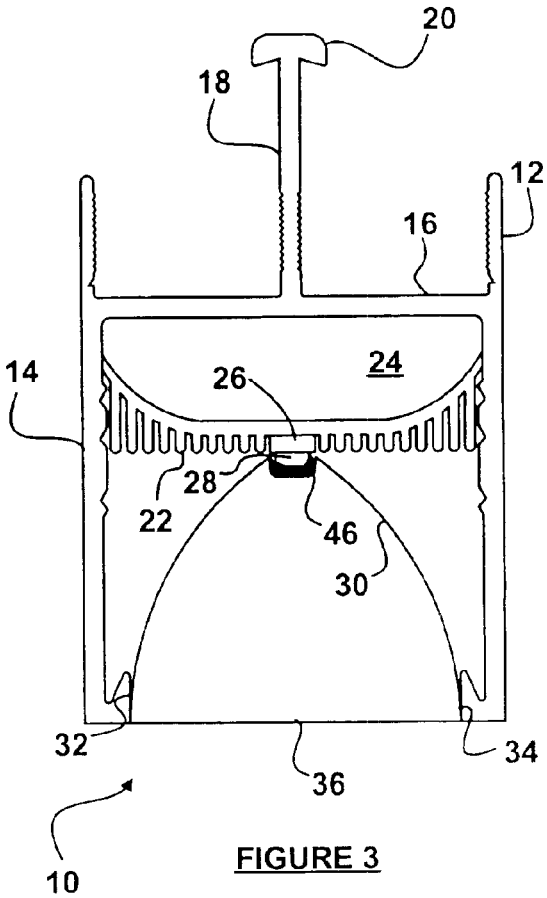
FIG. 3 is similar to FIG. 1 and shows a refractive index matching compound applied between the solid state lighting device and the light output reflector.

The light transmitting efficiency of fixture 10 can be further improved by applying a refractive index matching compound 46 (FIG. 3) such as an uncured silicone elastomer (i.e. catalog no. OCA5170 available from H.W. Sands Corp., Jupiter, Fla.) between lens 28 and the adjacent portion of reflector 30, for example, through liquid injection. Such compounds are especially beneficial if reflector 30 is formed of a high refractive index material as aforesaid, since such materials are characterized by significant Fresnel surface reflections, which are preferably minimized. More particularly, the Fresnel reflection R between a given material and air adjacent thereto is given by:

$$R = \frac{1}{2}\left[\frac{\sin^2(1-r)}{\sin^2(1+r)} + \frac{\tan^2(i-r)}{\tan^2(i+r)}\right]$$

where i is the angle at which light is incident upon the material, r is the refraction angle in accordance with Snell's Law: $r=\sin^{-1}(\sin(i/n_2))$ and $n_2$ is the material's refractive index.

Figure 4A:
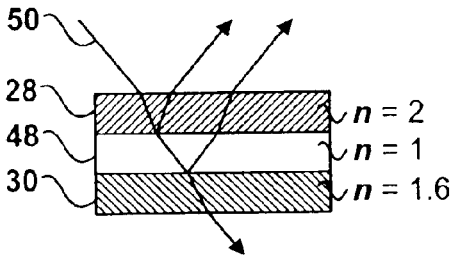
FIGS. 4A and 4B schematically depict the effect of coupling a refractive index matching compound between the solid state lighting device and the light output reflector.
Figure 4B:
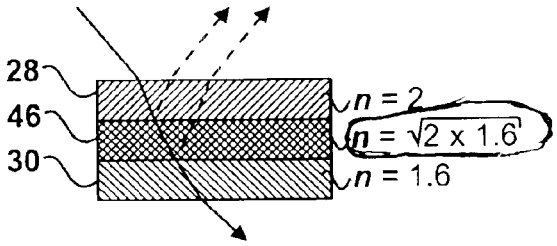

An efficient refractive index-matching compound is one whose refractive index equals the geometric mean of the refractive indices of the two materials between which the compound is placed. FIG. 4A schematically depicts the situation in which no index-matching compound is applied between lens 28 (n~2) and reflector 30 (n~1.6), leaving an air (n~1) gap 48 there-between. Consequently, incident ray 50 undergoes undesirable reflection at the polymer:air interface between lens 28 and gap 50; and again undergoes undesirable reflection at the air:polymer interface between gap 48 and reflector 30. FIG. 4B depicts the situation in which an index-matching compound 46 having a index of refraction ($n\sim\sqrt{2\times1.6}\sim1.79$, i.e. the square root of the product of the indices of refraction of lens 28 and reflector 30) is applied between lens 28 and reflector 30 leaving no air gap there-between. The effect is to reduce unwanted fresnel reflections, with the desired reducing effect increasing as the difference in the refractive index of the two materials between which the compound is placed increases.

Figure 5:
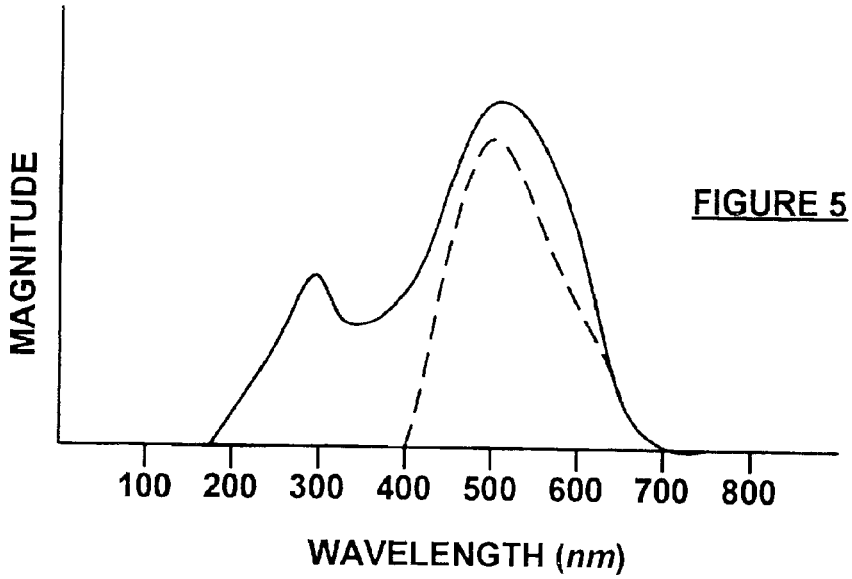
FIG. 5 graphically depicts the effect of forming the light output reflector of a spectrally selective filter material.

The light transmitting efficiency of fixture 10 can be further improved by forming reflector 30 and/or its lower face 36 of a spectrally selective filter material such as a GAM deep dyed polyester color filter (available from GAM Products, Inc., Hollywood, Calif.) to prevent transmission of selected light wavelengths into the clean room. Such formation can be via dye injection during the moulding process used to form reflector 30, or through addition of a color filter film. Alternatively, a spectrally selective thin film filter material can be applied to reflector 30 and/or its lower face 36 by means of chemical vapour deposition. Spectral selectivity is particularly important if the clean room is to be used for lithographic production of integrated circuit chips, since certain light wavelengths interfere with the highly precise lithography process. Commonly, light wavelengths in the 400 nm (blue) through to and including the ultraviolet and smaller wavelength ranges are prohibited in clean rooms used for such lithography. FIG. 5 graphically depicts the effect of such spectral filtration. The solid line curve represents a typical light output characteristic of fixture 10 without spectral filtration as aforesaid. The dashed line curve represents a typical light output characteristic of fixture 10 with spectral filtration as aforesaid to remove light wavelengths less than about 400 nm.

Figure 6:
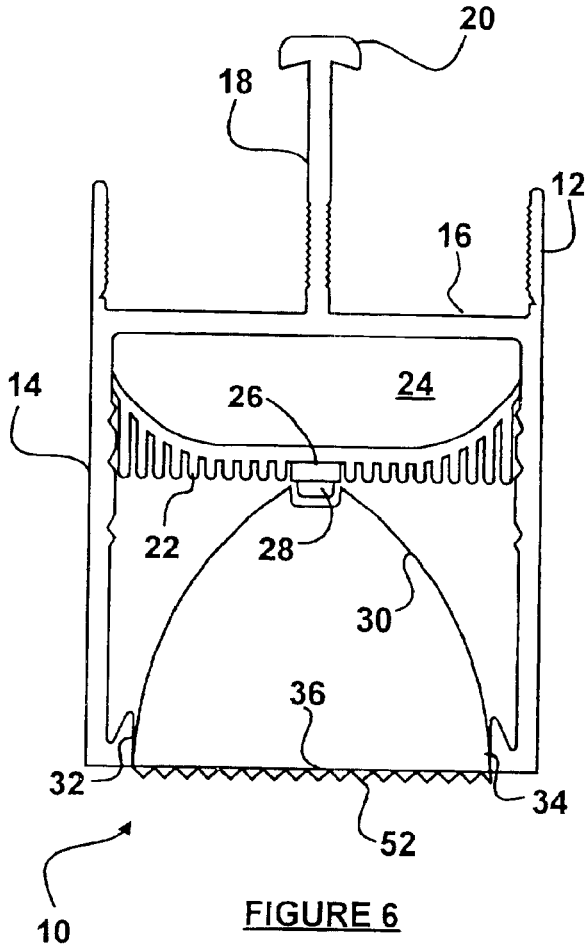
FIG. 6 is a cross-sectional end view of a clean room ceiling lighting fixture incorporating a holographic diffusion lens in accordance with the invention.

It is preferable that fixture 10 distribute light uniformly throughout the clean room space illuminated by fixture 10. In the case of some types of small LEDs 26 with highly directional light output characteristics and/or in the case of some clean room configurations, it may be necessary to provide a holographic diffusion lens 52 between flanges 32, 34 as shown in FIG. 6 in order to attain the desired uniform illumination. (In this context, "holographic" means that lens 52 is replicated from a holographically recorded master.) Examples of suitable holographic diffusion lenses are structured surface prismatic films such as Light Shaping Diffuser® films available from Physical Optics Corporation, Torrance, Calif.; or, more complex prismatic structures akin to Fresnel lenses such as custom-manufactured precision injection molded films capable of cost effectively spreading the LEDs' light over a relatively large area in a non-directional manner.

Figure 7:
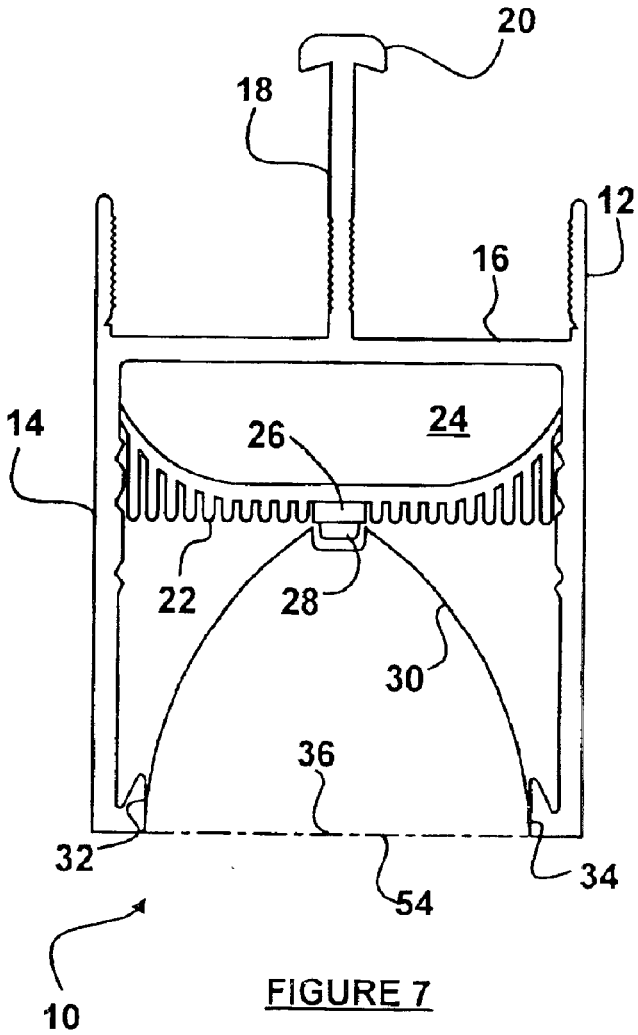
FIG. 7 is cross-sectional end view of a clean room ceiling lighting fixture having a solid state lighting device incorporating a variably transmissivity filter.
Figure 8:
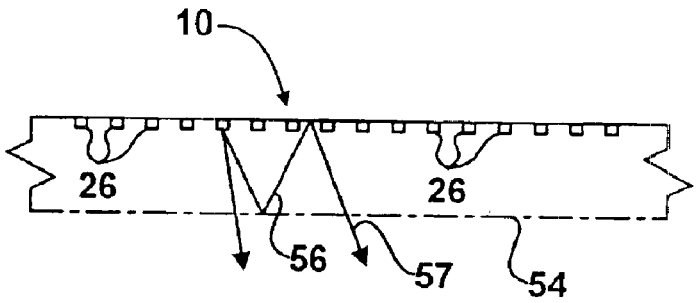
FIG. 8 is a fragmented, schematic cross-sectional side elevation view of the FIG. 1 lighting fixture, incorporating the FIG. 7 variably transmissivity filter therein.

The desired uniform light output effect can also be attained or improved by providing a variable transmissivity filter 54 of the type(s) described in U.S. Pat. No. 4,937,716 on reflector 30's lower face 36, as shown in FIG. 7. As explained in the '716 patent, variable transmissivity filter 54 minimizes dark and/or bright spots which would otherwise be perceived at different regions on lower face 36, due to the highly directional point source characteristic of LED 26. As shown in FIG. 8, light which would otherwise be transmitted through and be perceived as a bright region is reflected as indicated at 56 (or attenuated) and may, after subsequent reflection(s) within fixture 10 be emitted through a different region 57 of variable transmissivity filter 54 which would otherwise be perceived as a dark region, thus enhancing the efficiency of fixture 10 by conserving the light output by LEDs 26 and achieving more uniform clean room illumination.

Figure 9:
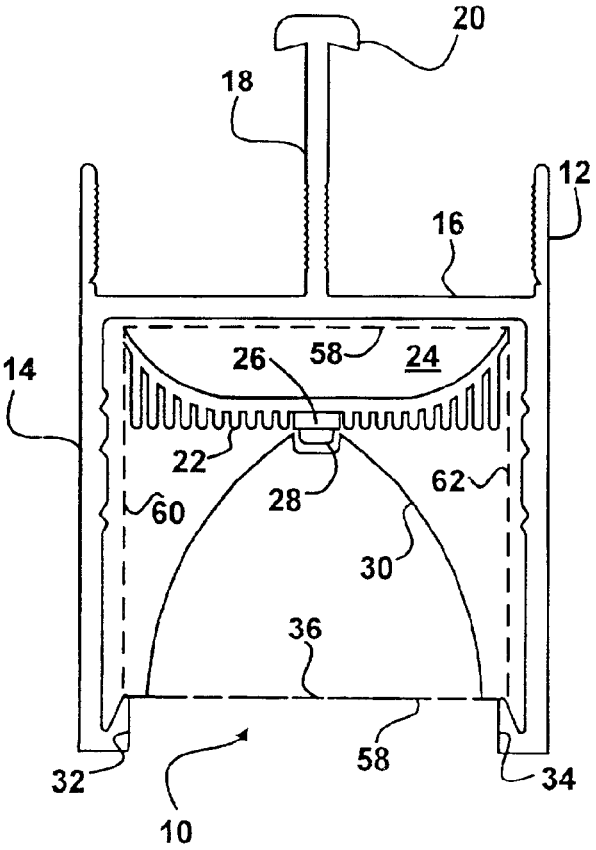
FIG. 9 is a cross-sectional end view of a clean room ceiling lighting fixture incorporating a replaceable solid state lighting module in accordance with the invention.

If light fixture 10 is to be retrofitted into an existing H-Bar type clean room ceiling then it will be advantageous to utilize removably replaceable lighting modules 58 as shown in FIG. 9. In an existing H-Bar type clean room ceiling, vertical frame members 12, 14; horizontal frame member 16; hanger 18; and, hanger rail 22 are already present. Each module 58 can be formed as a pre-sealed, thin-walled oblong box containing heat sink 22, cable raceway 24, and a plurality of solid state lighting LEDs 26 with their associated lenses 28 and reflectors 30 together with anti-reflective coatings, refractive index matching compounds, holographic diffusion filters, and/or variable transmissivity filters as previously described. Side walls 60, 62 of module 58 can be made flexible for removable snap-fit engagement of module 58 with flanges 32, 34. Alternatively, if the H-Bar ceiling structure is formed of a magnetic material, module 58 can be removably magnetically retained between vertical frame members 12, 14 by forming module 58's side walls of a magnetized material. If the H-Bar ceiling structure is formed of a non-magnetic material, a ferro-magnetic material can be mechanically fastened to selected portions of the ceiling structure to magnetically retain module 58 as aforesaid. As a further alternative, module 58 can be removably adhesively retained between vertical frame members 12, 14. Besides facilitating rapid retrofitting of lighting fixtures into a clean room ceiling, module 58 facilitates simple, rapid replacement of defective modules, even while the clean room is operating, since there is no danger of fluorescent tube glass breakage or the release of phosphors into the clean room environment.

Figure 10:
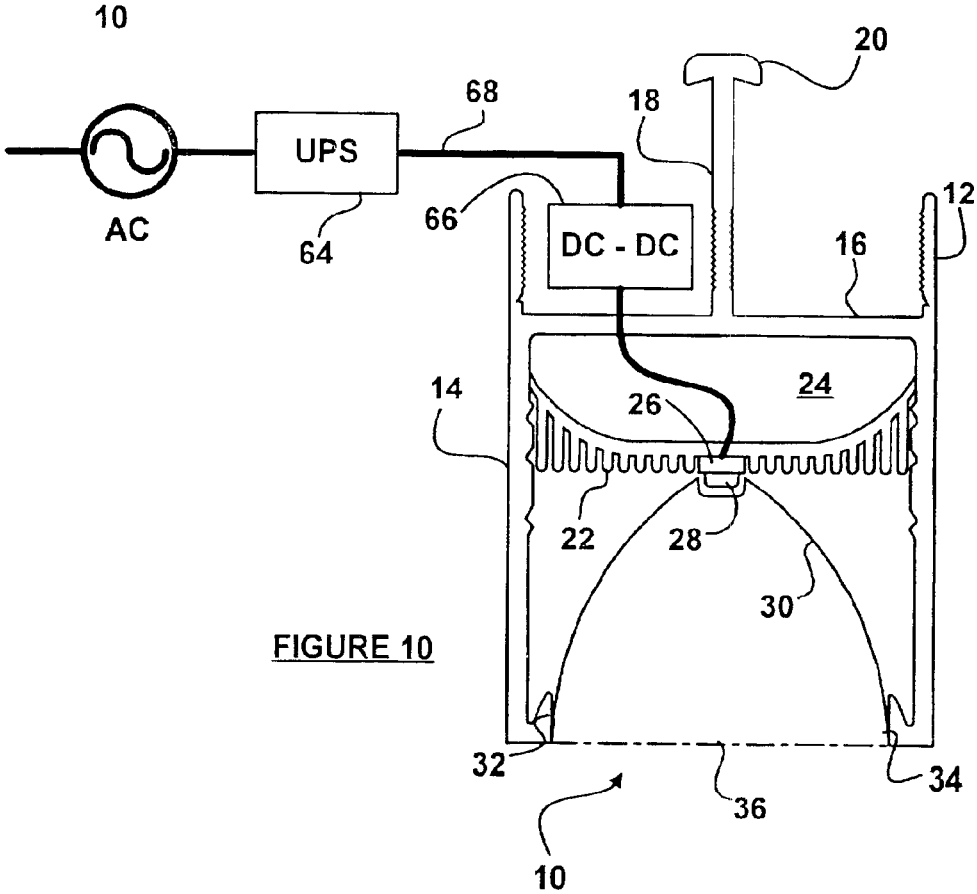
FIG. 10 is a cross-sectional end view of a clean room ceiling lighting fixture in accordance with the invention, showing an uninterruptible power supply and in-line DC-DC converter in block diagram form.

As shown in FIG. 10, an uninterruptible power supply (UPS) 64 can be located remotely from lighting fixtures 10 or modules 58; and/or an in-line DC-DC converter 66 can be located close to each of lighting fixtures 10 or modules 58 to efficiently distribute electrical power to LEDs 26. UPS 64 allows the clean room to remain illuminated in the event of a power failure. It is normally sufficient to illuminate only a few of lighting fixtures 10 or modules 58 to maintain adequate clean room emergency lighting, so UPS 64 need only be electrically connected to a selected few of lighting fixtures 10 or modules 58.

LEDs 26 operate most efficiently as low-voltage DC devices. However, low-voltage DC power is not efficiently transmitted through conventional ceiling light fixture power conductor 68, due to resistive losses. If one of in-line DC-DC converters 66 is located close to each one of lighting fixtures 10 or modules 58, then DC power can be efficiently transmitted through conventional power conductor 68 to converters 66 at less lossy, higher DC voltage levels. Converter 66 then converts the power signal to the lower DC voltage level required by LEDs 26 thus achieving efficient electrical power distribution to lighting fixtures 10 or modules 58.

By carefully regulating the power delivered to LEDs 26 over time, one may maintain adequate clean room light levels over longer time periods. Although LEDs 26 have extremely long lifetimes (typically in excess of 100,000 hrs), their light output characteristic degrades over time if they are driven by a constant current signal. The "useful" lifetime of LEDs 26 (i.e. the time during which the light output of LEDs 26 is adequate for clean room illumination purposes) can be extended by regulating the power delivered to LEDs 26 such that their light output intensity does not fall below a prescribed minimum level. This can be achieved by installing suitable light sensors (not shown) in the clean room and regulating the drive current applied to LEDs 26 as a function of (for example, in inverse proportion to) the light sensors' output signals; or, by manually varying the power delivered to LEDs 26 by preselected amounts at preselected times; or, via a suitably programmed electronic controller (not shown) coupled to lighting fixtures 10 or modules 58. Such regulation of the drive current applied to LEDs 26 may reduce the total lifetime of LEDs 26 if LEDs 26 are over-driven as they approach the end of their "useful" lifetimes, but the LEDs' total useful lifetime is extended as previously explained, and as is shown in FIGS. 12A–12F.

Figure 12A:
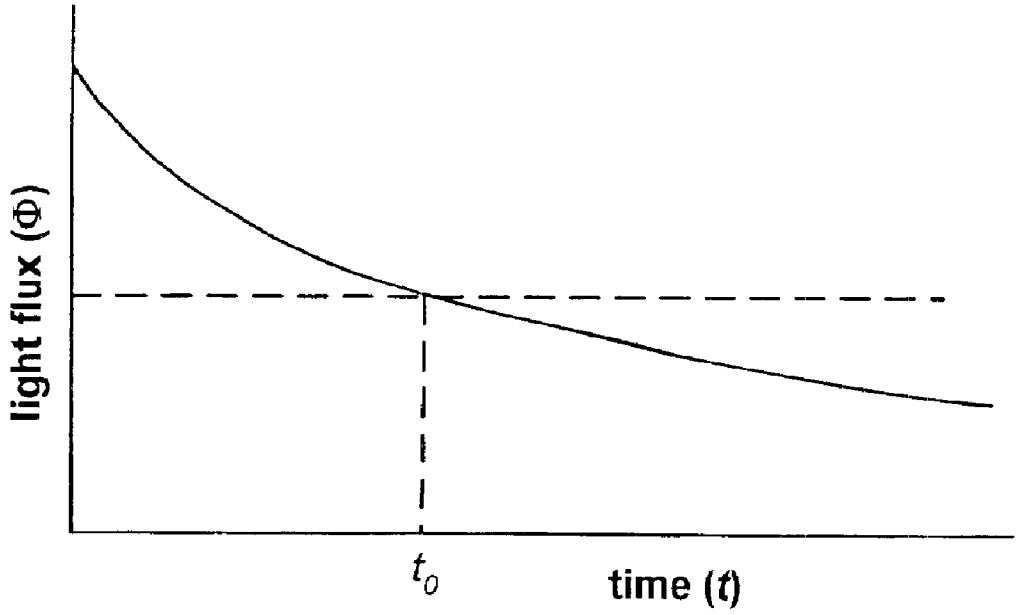
FIGS. 12A–12F graphically depict the effect of light output regulation in accordance with the invention, with the upper and lower graphs in each Figure respectively plotting light flux (Φ) and power (P) as functions of time (t).
Figure 12B:
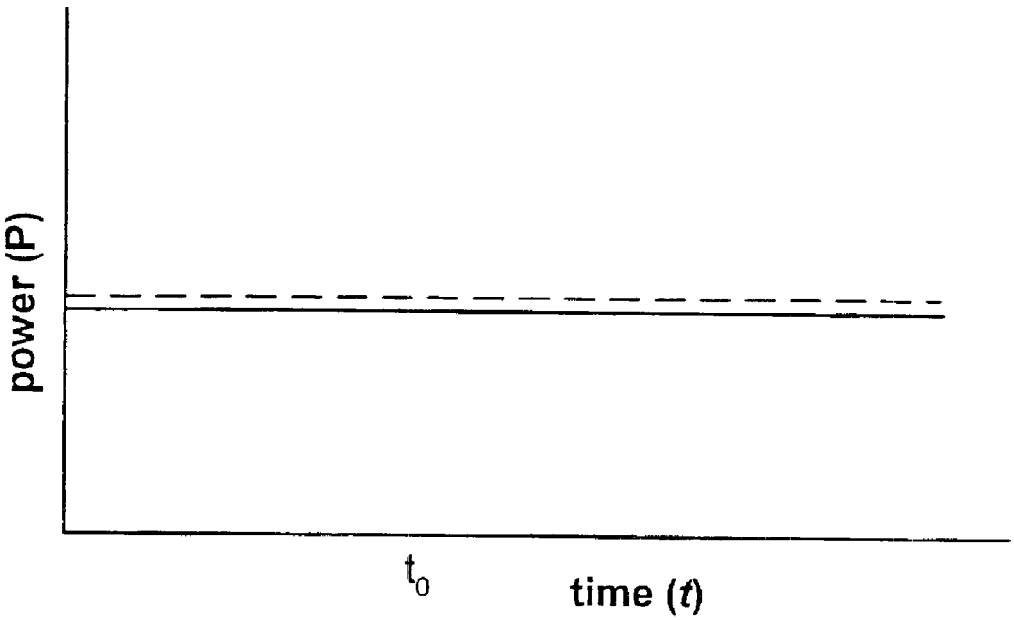

FIGS. 12A, 12B depict the situation in which a constant power drive signal (solid line in FIG. 12B) is applied to LEDs 26 such that the light flux (Φ) output by LEDs 26 (FIG. 12A) decreases with time. The horizontal dashed line in FIG. 12A represents the minimum acceptable light flux output of LEDs 26. The horizontal dashed line in FIG. 12B represents the maximum input power rating of LEDs 26. The FIG. 12B constant power drive signal applied to LEDs 26 is slightly less than the maximum input power rating of LEDs 26. As seen in FIG. 12A, the light flux (Φ) output by LEDs 26 decreases until a time $t_0$ representative of the time at which LEDs 26 must be replaced because they can no longer produce the minimum acceptable light flux output.

Figure 12C:
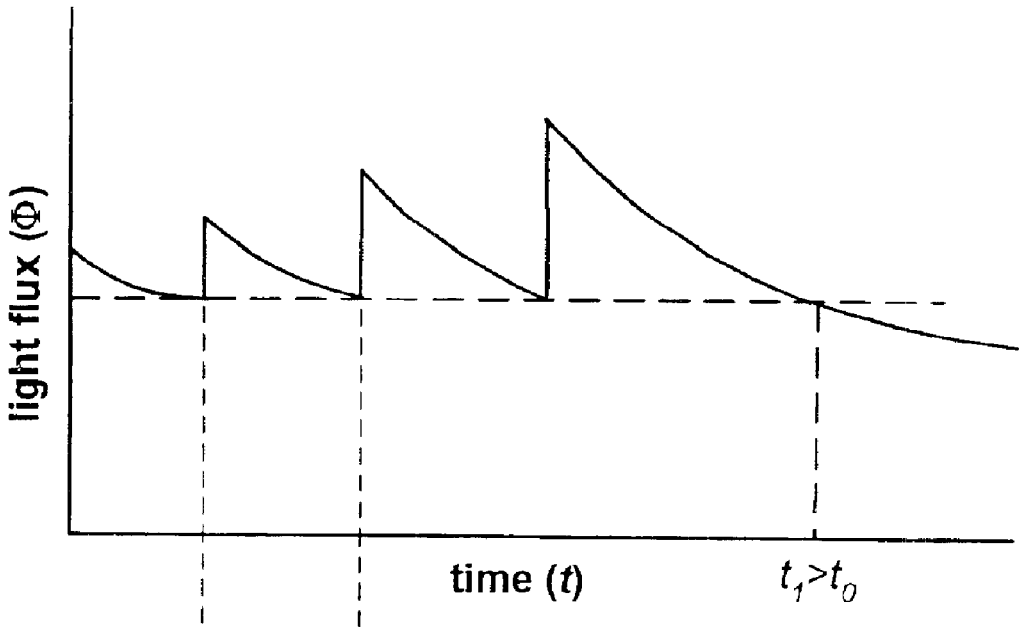
Figure 12D:
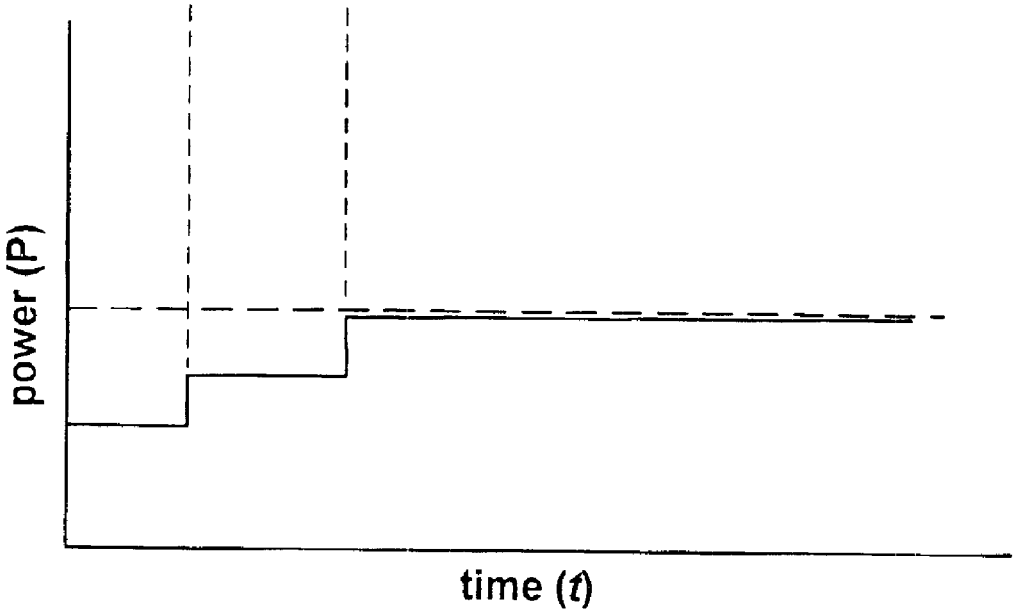

FIGS. 12C, 12D depict an improved situation in which the power drive signal (solid lines in FIG. 12D) applied to LEDs 26 is increased at periodic intervals to produce corresponding increases in the light flux (Φ) output by LEDs 26 (FIG. 12C). The horizontal dashed lines in FIGS. 12C, 12D again respectively represent the minimum acceptable light flux output of LEDs 26 and the maximum input power rating of LEDs 26. As seen in FIG. 12C, the light flux (Φ) output by LEDs 26 is periodically increased as aforesaid until a time $t_1>t_0$ representative of the time at which LEDs 26 must be replaced because they can no longer produce the minimum acceptable light flux output.

Figure 12E:
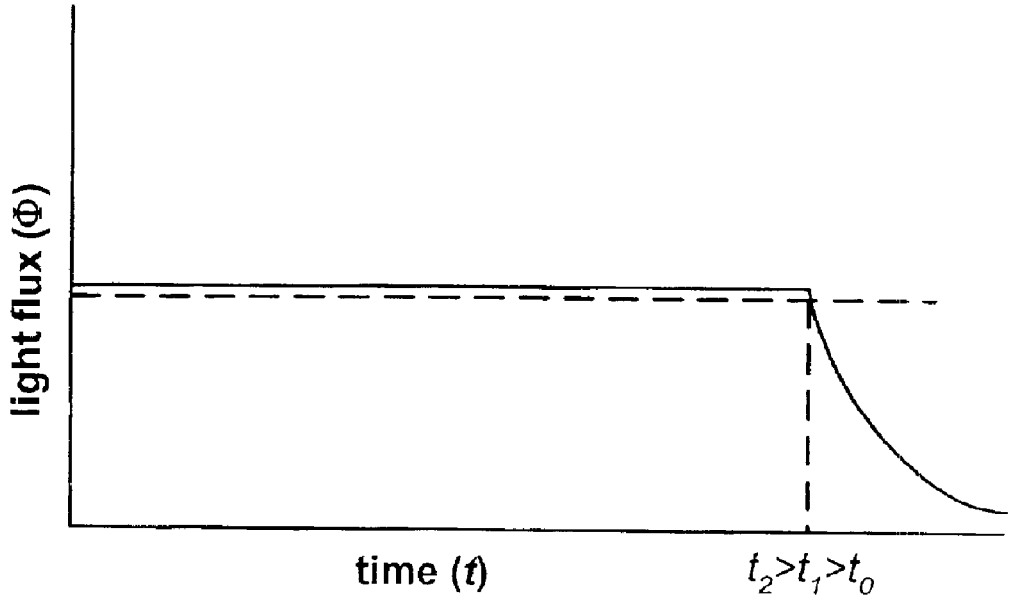
Figure 12F:
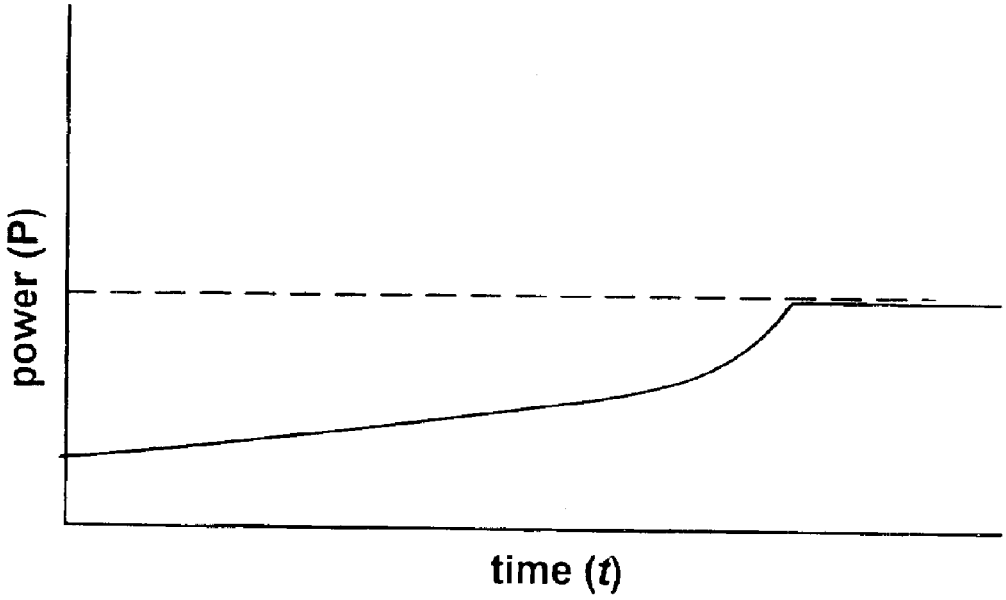
Figure 13A:
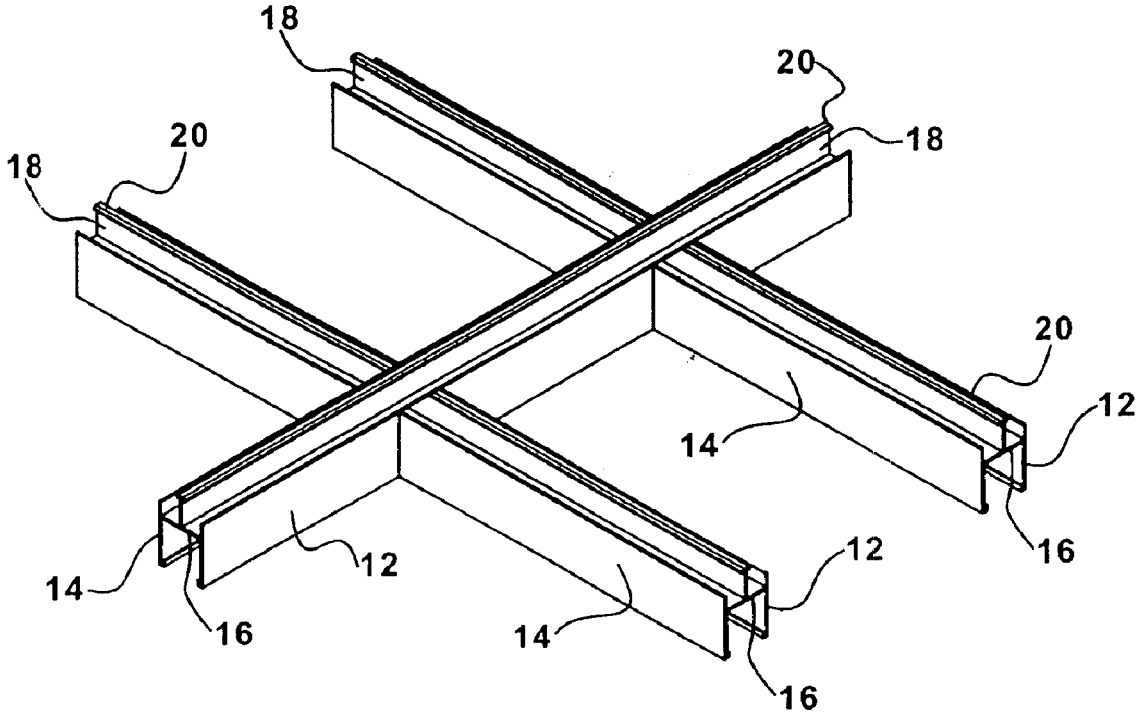
FIG. 13A is an oblique pictorial illustration of a plurality of clean room ceiling light fixture housings in accordance with the invention, arranged in an H-Bar configuration.
Figure 13B:
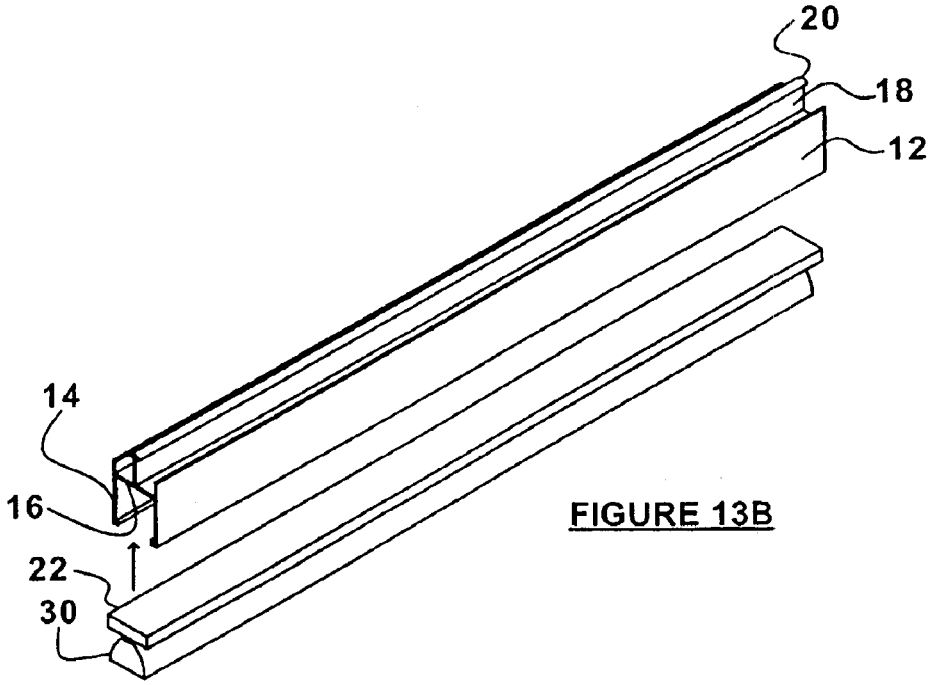
FIG. 13B is an oblique pictorial illustration of a clean room ceiling light fixture housing in accordance with the invention, schematically depicting the relationship between the frame members, the heat sink, and the reflector.

FIGS. 12E, 12F depict a further improvement in which the power drive signal (solid curve in FIG. 12F) applied to LEDs 26 is continuously increased over time to maintain the light flux (Φ) output by LEDs 26 at a constant level (FIG. 12E). The horizontal dashed lines in FIGS. 12E, 12F again respectively represent the minimum acceptable light flux output of LEDs 26 and the maximum input power rating of LEDs 26. As seen in FIG. 12E, the light flux (Φ) output by LEDs 26 remains constant until a time $t_2>t_1>t_0$ representative of the time at which LEDs 26 must be replaced because they can no longer produce the minimum acceptable light flux output.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A light fixture for a clean room ceiling formed by a plurality of frame members arranged in an H-Bar configuration, the light fixture comprising:

(a) a sealed housing module sized and shaped for removably replaceable engagement within the ceiling frame members, the module having a downwardly-directed light emitting aperture;

(b) a heat sink fixed within the module and spaced from an internal wall of the module to define a cable raceway between the heat sink and the internal wall;

(c) a plurality of light-emitting diodes mounted within the module on the heat sink, each one of the light-emitting diodes having a lens for directing light emitted by the one of the light-emitting diodes through the aperture into the clean room; and, (d) a power supply for applying drive current to the light-emitting diodes.

2. A light fixture as defined in claim 1, each one of the light-emitting diodes further having a reflector for directing light emitted by the one of the light-emitting diodes through the aperture into the clean room.

3. A light fixture as defined in claim 1, further comprising an anti-reflective coating on each one of the lenses.

4. A light fixture as defined in claim 2, further comprising an anti-reflective coating on each one of the reflectors.

5. A light fixture as defined in claim 2, wherein the reflectors are formed of a high refractive index material.

6. A light fixture as defined in claim 5, wherein the high refractive index material is polycarbonate.

7. A light fixture as defined in claim 2, further comprising, for each one of the lenses and an adjacent one of the reflectors, a refractive index matching compound applied between the one of the lenses and the adjacent one of the reflectors.

8. A light fixture as defined in claim 7, wherein the refractive index matching compound is an elastomer.

9. A light fixture as defined in claim 2, wherein the reflectors are formed of a spectrally selective filter material.

10. A light fixture as defined in claim 9, wherein the spectrally selective filter material is a deep dyed polyester.

11. A light fixture as defined in claim 9, wherein the spectrally selective filter material is a spectrally selective thin film filter material.

12. A light fixture as defined in claim 1, further comprising, a holographic diffusion lens for uniformly distributing, through the aperture, the light emitted by the light-emitting diodes.

13. A light fixture as defined in claim 12, wherein the holographic diffusion lens further comprises a structured surface prismatic film.

14. A light fixture as defined in claim 1, further comprising; a variable transmissivity filter for uniformly distributing, through the aperture, the light emitted by the light-emitting diodes.

15. A light fixture as defined in claim 1, wherein the module is removably magnetically attachable to the ceiling frame members.

16. A light fixture as defined in claim 1, wherein the module is removably adhesively attachable to the ceiling frame members.

17. A light fixture as defined in claim 1, wherein the power supply further comprises an uninterruptible power supply.

18. A light fixture as defined in claim 1, wherein the power supply further comprises an in-line DC-DC converter coupled between a high voltage DC power supply and the fixture.

19. A light fixture as defined in claim 17, wherein the power supply further comprises an in-line DC-DC converter coupled between the uninterruptible power supply and the fixture.

20. A light fixture as defined in claim 17, wherein the uninterruptible power supply is located at a remote location from the fixture.

21. A light fixture as defined in claim 19, wherein the uninterruptible power supply is located at a remote location from the fixture.

22. A light fixture as defined in claim 18, wherein the DC-DC in-line converter is located closely proximate to the fixture.

23. A light fixture as defined in claim 19, wherein the DC-DC in-line converter is located closely proximate to the fixture.

24. A light fixture as defined in claim 21, wherein the DC-DC in-line converter is located closely proximate to the fixture.

25. A light fixture as defined in claim 1, wherein the power supply further comprises a regulator for regulating the drive current as a function of time.

26. A light fixture as defined in claim 25, further comprising a light sensor located in the clean room and electrically connected to the regulator, the light sensor producing an output signal representative of light intensity near the light sensor, and wherein the regulator further regulates the drive current as a function of the output signal.

27. A light fixture as defined in claim 25, further comprising a light sensor located in the clean room and electrically connected to the regulator, the light sensor producing an output signal having a magnitude representative of light intensity near the light sensor, and wherein the regulator further regulates the drive current in inverse proportion to the output signal magnitude.

28. A light fixture as defined in claim 1, further comprising a programmable controller electrically connected between the power supply and the light-emitting diodes, the programmable controller for programmatically regulating the drive current as a function of time.

29. A light fixture as defined in claim 1, further comprising a programmable controller electrically connected between the power supply and the light-emitting diodes, the programmable controller for programmatically regulating the drive current as a function of time to maintain substantially constant light flux output of the light-emitting diodes.

* * * * *